US006655691B2

(12) United States Patent
Yong Hwan

(10) Patent No.: US 6,655,691 B2
(45) Date of Patent: Dec. 2, 2003

(54) SHOOTING GAME MACHINE

(75) Inventor: Kim Yong Hwan, Seoul (KR)

(73) Assignee: Andamiro Co., Ltd., Seoul (KR)

( * ) Notice: Subject to any disclaimer, the term of this patent is extended or adjusted under 35 U.S.C. 154(b) by 0 days.

(21) Appl. No.: 10/001,283

(22) Filed: Nov. 30, 2001

(65) Prior Publication Data

US 2003/0006558 A1 Jan. 9, 2003

(30) Foreign Application Priority Data

Jul. 9, 2001 (KR) ..... 20-2001-20681
Jul. 9, 2001 (KR) ..... 20-2001-20682
Jul. 9, 2001 (KR) ..... 10-2001-40933

(51) Int. Cl.[7] ..... F41J 7/00
(52) U.S. Cl. ..... 273/356; 273/390; 273/393; 273/407
(58) Field of Search ..... 273/355–357, 273/359, 366–370, 390–392, 393, 406, 407

(56) References Cited

U.S. PATENT DOCUMENTS 1,477,698 A * 12/1923 Emmelin ..... 124/73
1,547,834 A * 7/1925 Smookler ..... 273/356
1,709,420 A * 4/1929 Weisser ..... 273/393
1,721,201 A * 7/1929 Bechtol et al. ..... 273/121 E
2,835,495 A * 5/1958 Lohr et al. ..... 273/356
4,875,459 A * 10/1989 Van Elderen et al. ..... 124/49
5,738,584 A 4/1998 Ikematsu et al.
6,217,026 B1 * 4/2001 Kang ..... 273/368

* cited by examiner

*Primary Examiner*—Mark S. Graham
(74) *Attorney, Agent, or Firm*—Greenblum & Bernstein, P.L.C.

(57) ABSTRACT

A shooting game machine having a gun for projecting bullets using compressed air and targets arranged in a predetermined distance in front of the gun includes a housing which is provided with at least one opening formed on a front wall thereof, a gun supporter mounted inside of the opening on the front wall of the housing for supporting the gun, and a target holding mechanism installed in front of the gun in a predetermined distance for holding at least one target.

20 Claims, 9 Drawing Sheets

PRIOR ART

SHOOTING GAME MACHINE

BACKGROUND OF THE INVENTION (a) Field of the Invention

The present invention relates to a shooting game machine, and in particular, to an improved shooting game machine capable of preventing a bullet shot from a gun from being damaged, due to an impact against wall of a housing of the shooting game machine, by applying impact absorbing means to the walls, giving a player aiming stability and preventing the gun from being stolen by fixing the gun to the housing, and making it easy to arrange targets.

(b) Description of the Related Art

Heretofore shooting game machines have been known in which targets are arranged in playing spots with model guns utilizing compressed air such that a gift is given to the player when a target is hit by a bullet shot from the gun.

FIG. 1 shows a conventional shooting game machine designed to allow a player to shoot the model gun while aiming at a target and FIG. 2 shows a target below which a gift is suspended.

As shown in FIG. 1 and FIG. 2, the conventional shooting game machine 102 is provided with a plurality of target holders 100 supported by a pair of rotational chains in a housing in such a manner that the target holder is horizontally interposed between the chains and both ends of the target holder 100 are connected to the chains 101 such that a target 103 rotates according to the chain rotation. The target 103 is made out of material that can be easily torn off in order for the gift 105 to fall down when the target is hit to tear.

Also, the shooting game machine 102 is provided with one or more aiming openings 104 formed on a front wall of the housing such that the gun is aimed at the target inside in housing by inserting a barrel of the gun. The gun is held in a gun-rest box 106 provided at the lower part of the front wall of the housing when the gun is not used.

However, the conventional shooting game machine has some drawbacks in that it is difficult to aim the model gun at the target because the gun is not supported by any tool but the aiming opening and it is likely to be stolen because the gun is kept in a separate gun-rest box when the gun is not used.

Also, the bullets can be broken by impact against the wall of the housing because the bullets are shot with highly compressed air.

Furthermore, when it is required to replace the used target with a new one, firstly the target holder 100 should be manually detached from the chains 101 and then putted in the place again after attaching the new target 103 to the target holder 100, resulting time-consuming.

SUMMARY OF THE INVENTION

The present invention has been made in an effort to solve the above problems of the prior art.

It is an object of the present invention to provide a shooting game machine capable of preventing a bullet shot from a gun from being damaged, due to an impact against the wall of housing, by employing impact absorbing material as the wall of the housing of the shooting game machine.

It is another object of the present invention to provide a shooting game machine capable of improving aiming stability and preventing the gun from being stolen by pivotally fixing the gun to the aiming opening.

It is still another object of the present invention to provide a shooting game machine capable of reducing target replacement time by simplifying the target holding mechanism.

To achieve the above object, the shooting game machine of the present invention comprises a housing which is provided with at least one opening formed on a front wall thereof, a gun supporter mounted inside of the opening on the front wall of the housing for supporting the gun, and a target holding mechanism installed in front of the gun in a predetermined distance for holding at least one target.

BRIEF DESCRIPTION OF THE DRAWINGS

The accompanying drawings, which are incorporated in and constitute a part of the specification, illustrate an embodiment of the invention, and together with the description, serve to explain the principles of the invention.

DETAILED DESCRIPTION OF THE PREFERRED EMBODIMENTS

A preferred embodiment of the present invention will be described hereinafter with reference to the accompanying drawings.

Figure 1:
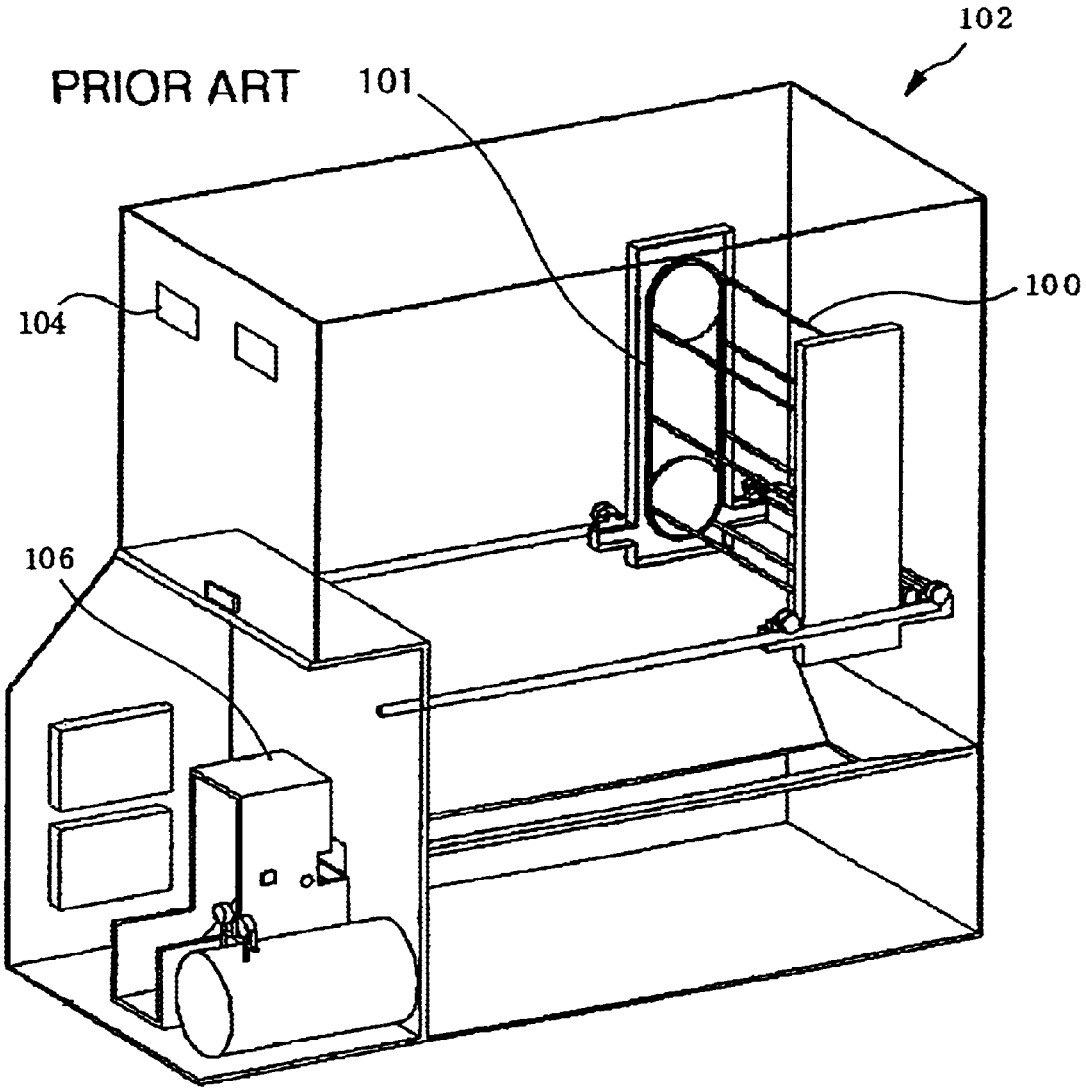
FIG. 1 is a perspective view showing a conventional shooting game machine.
Figure 2:
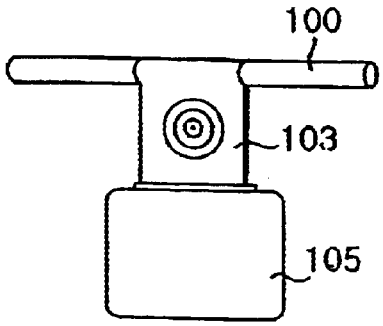
FIG. 2 is a front view showing a target suspended from a target holder of the shooting game of FIG. 1 together with a gift.
Figure 3:
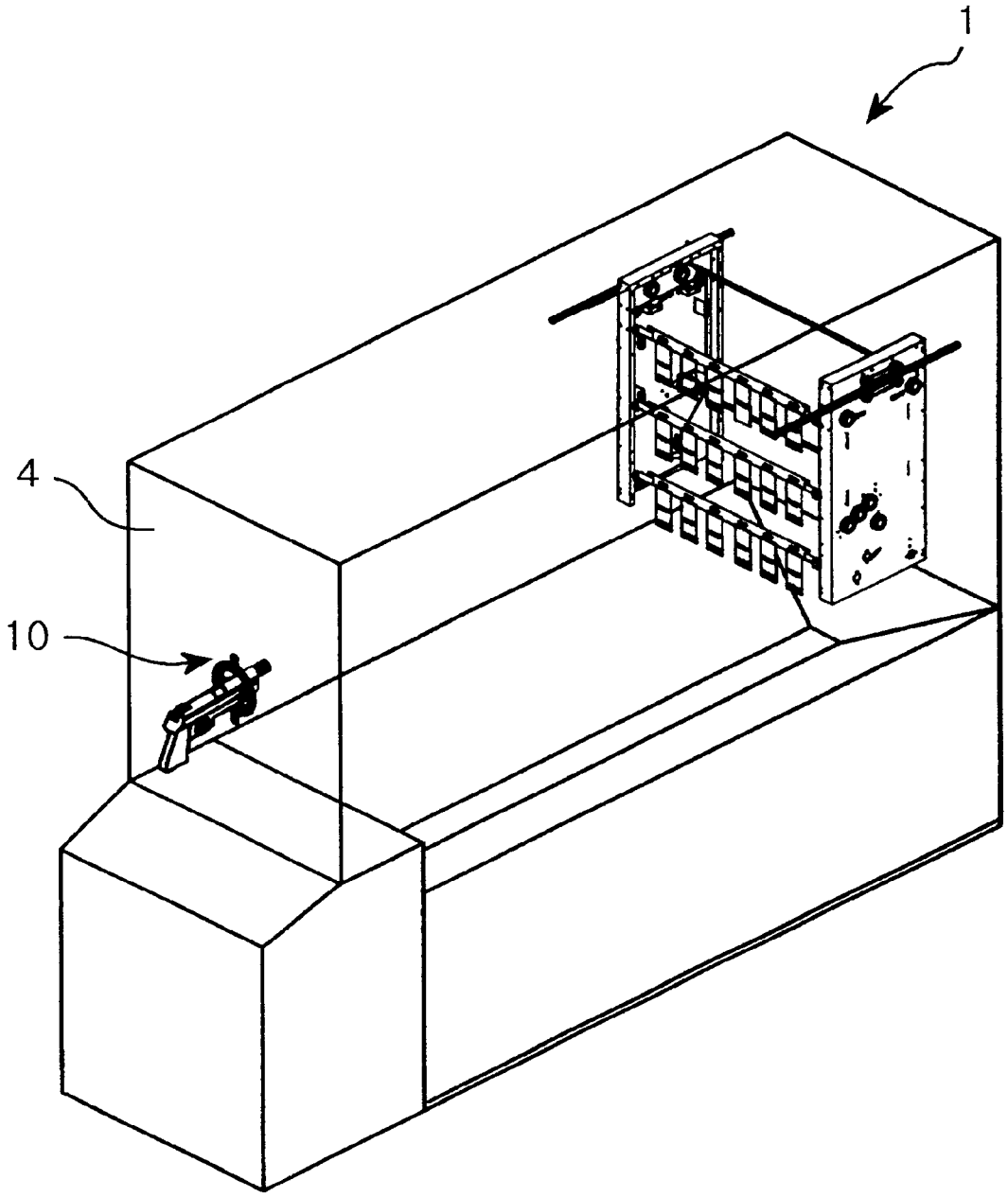
FIG. 3 is a schematic view showing a shooting game machine according to a preferred embodiment of the present invention.
Figure 4:
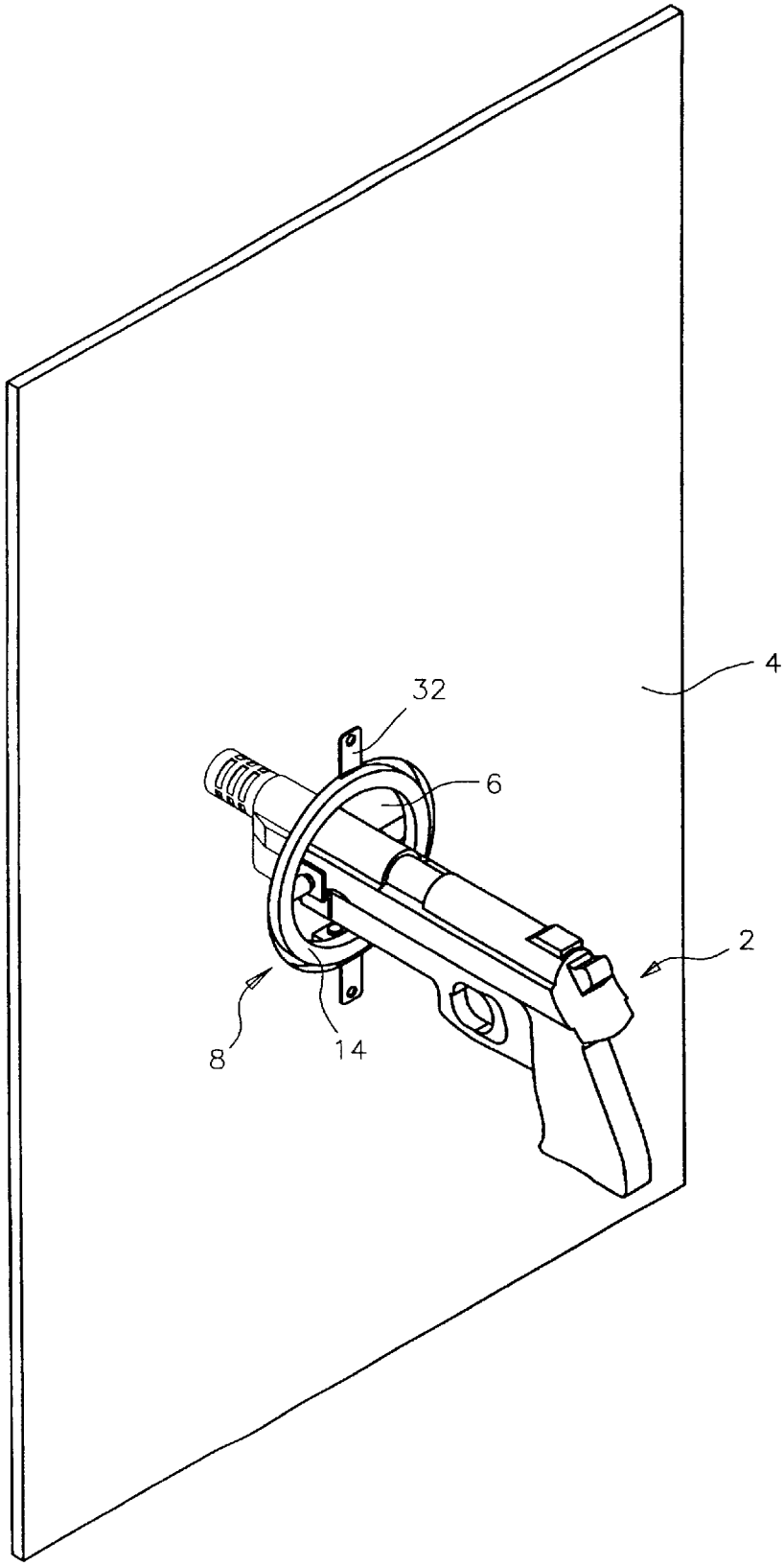
FIG. 4 is a perspective view showing a gun supporter of the shooting game machine of FIG. 3 together with a gun fixed thereto.
Figure 5:
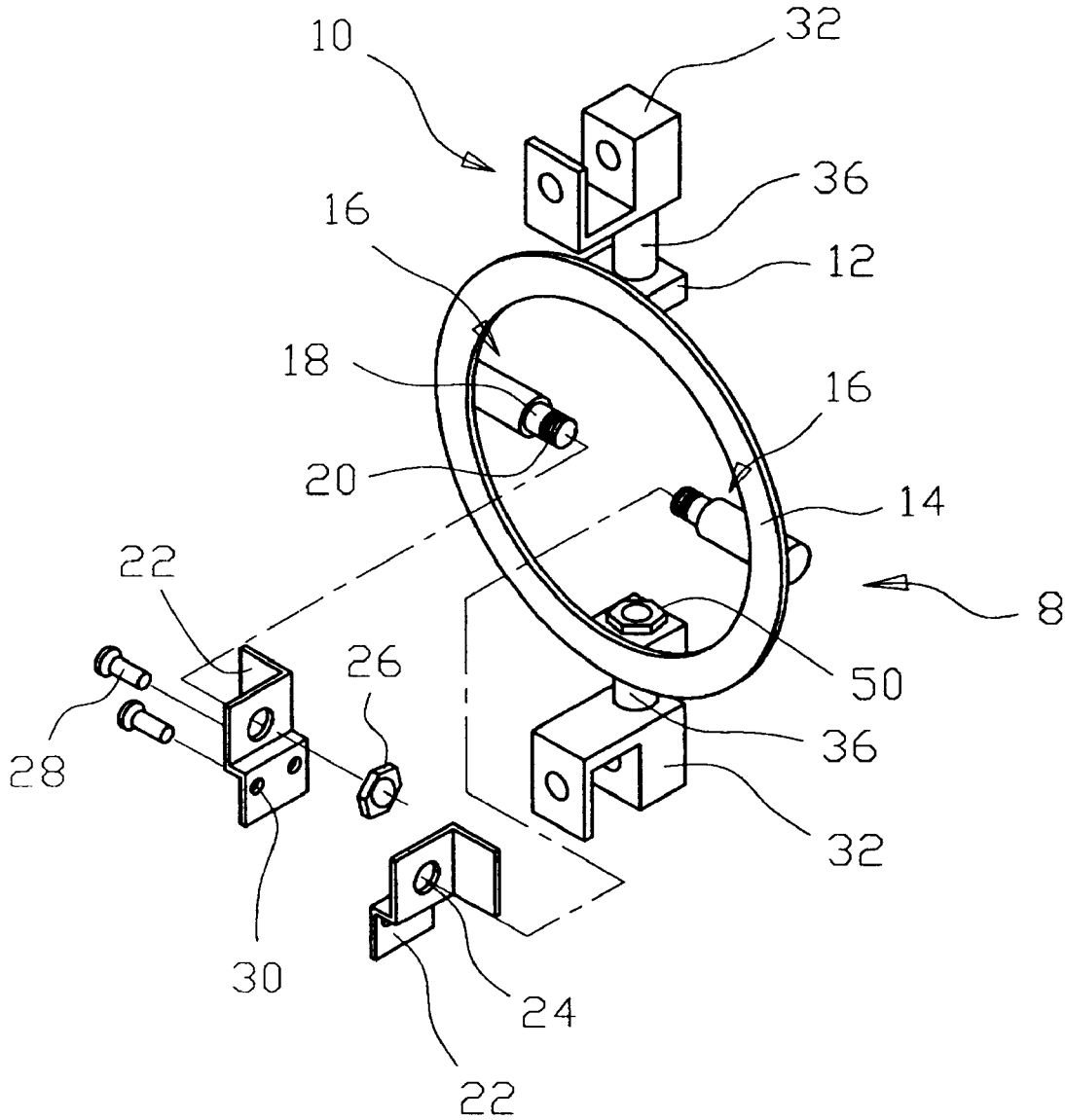
FIG. 5 is an exploded perspective view showing the gun supporter of the shooting game machine of FIG. 3.
Figure 6:
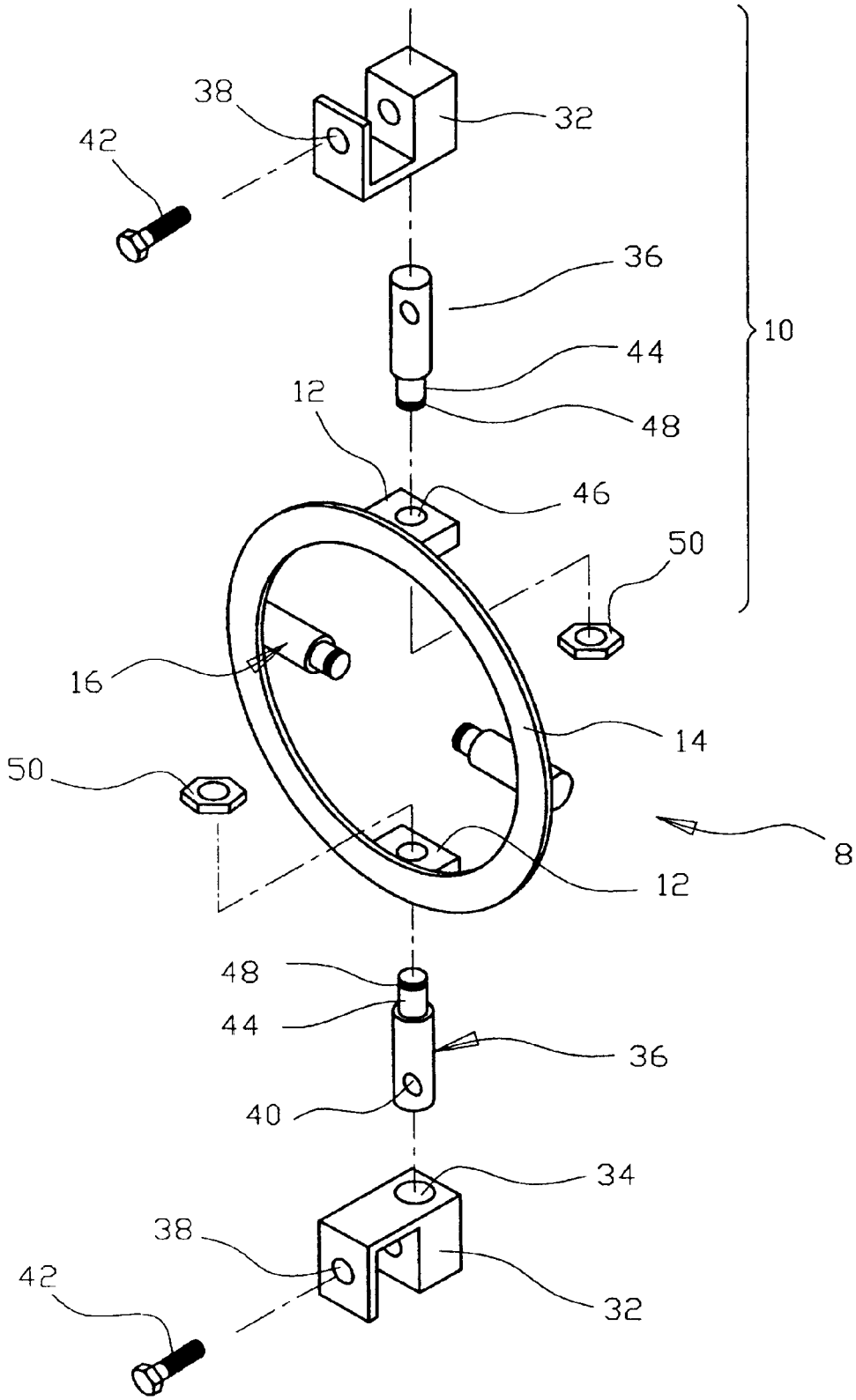
FIG. 6 is an exploded view for illustrating how the gun supporter is assembled.
Figure 7:
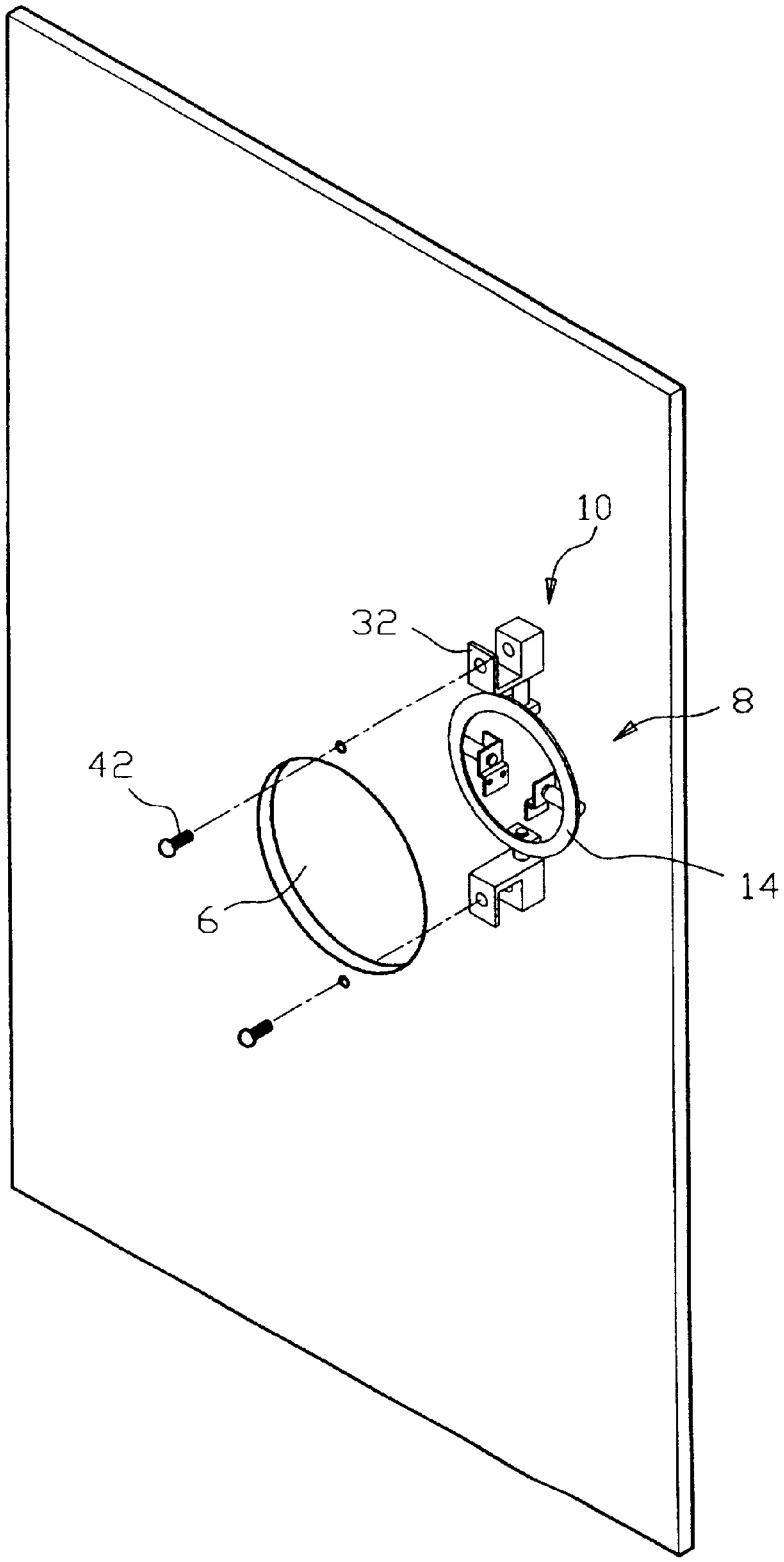
FIG. 7 is a perspective view for illustrating how the gun supporter is mounted to a housing the shooting game machine.
Figure 8:
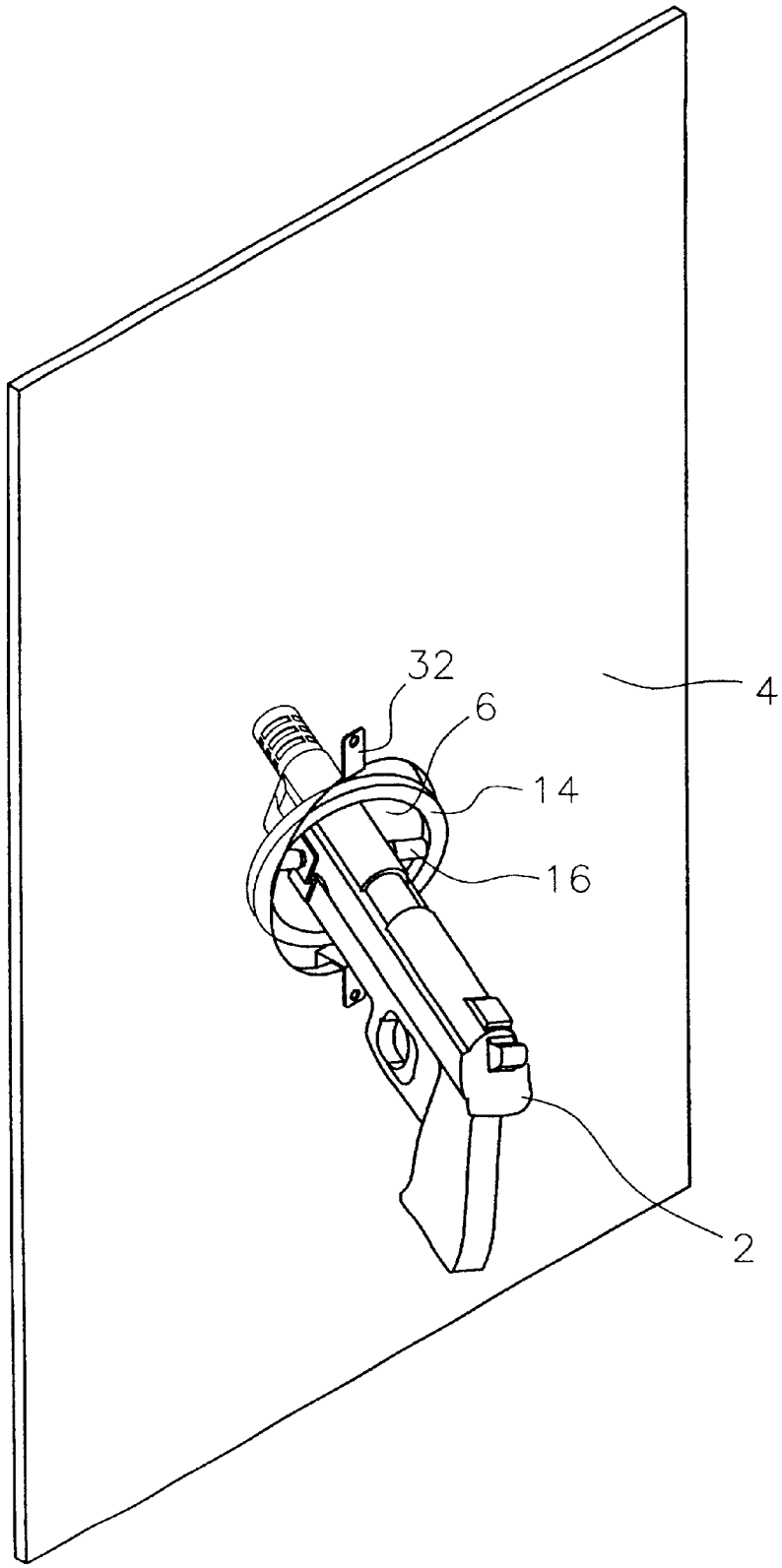
FIG. 8 is a perspective view for illustrating how the gun is supported by the gun supporter.

FIG. 3 shows a shooting game machine according to a preferred embodiment of the present invention.

As shown in FIG. 3, the shooting game machine of the present invention comprises a housing 1 having a shape of rectangular box, target holding means installed near a rear wall of the housing 1 for holding a plurality of targets, at a gun supporter 8 mounted around an opening formed on a front wall of the housing 1 for supporting a gun. The gun shoots bullets using compressed air supplied from an air compressor.

FIG. 4–FIG. 8 are perspective views for illustrating how the gun supporter is assembled and mounted on the housing.

As shown in the drawings, the gun supporter 8 is fixedly mounted around an opening 6 formed on the front wall 4 of the housing 1. The front wall 4 is manufactured using a transparent material such as plastic or glass such that the player can watch and aim the gun at the target.

The gun supporter 8 comprises a rotation ring 14 having a outer diameter less than inner diameter of the opening 6, a pair of connectors 10 for pivotally connecting the rotation ring 14 to a circumferential edge of the front wall at upper and lower end portions of the opening 6, and a pair of studs 16 oppositely and coaxially fixed on the rotation ring 14 for rotationally connecting the gun to the rotation ring 14.

The rotation ring 14 has a pair of projections 12 perpendicularly projected from the rotation ring 14 confronting each other and having respective connection holes 46 coaxially arranged.

Each connector 10 comprises a connecting bracket 32 having a shape of "U" such that an indented space thereof is engaged with circumferential edge of the opening 6 of the front wall 4, the bracket 32 having holes 38 coaxially crossing the indented space of the connecting bracket 32; and a cylindrical shaft 36 of which one end is tightly inserted into a receiving hole 34 formed on the connecting bracket 32 in an opposite direction of the indented space of the connecting bracket 32, the shaft 36 having a hole 40 formed coaxial with the holes 38 of the connecting bracket 32 when the shaft 36 is fixed in the receiving hole 34 of the connecting bracket 32 and having a stepped portion 44 having a smaller diameter than that of the shaft 36 of which end portion is threaded so as to be screwed into a nut 50 after the stepped portion 44 is inserted into the hole 46 formed on each projection 12 of the rotation ring 14.

The studs 16 are oppositely and coaxially fixed on the rotation ring 14 at an angle of 90° relative to the positions of the projections 12 and each stud has stepped end portion 18 having a smaller diameter than that of the stud 16 and threaded, such that a pair of connecting plates 22 pivotally mounted on the studs 16 by inserting the end portions 18 of the studs 16 into holes 24 formed on the connecting plates 22 and screwing nuts on the end portions 18.

Accordingly, the gun is pivotally suspended from the studs 16 by fixing the gun to the connecting plates 22 by screwing bolts 28 into fixing holes (not shown) at a lower portion of a barrel of the gun 2 through fixing holes 30 formed lower portion of the connecting plates 22. How the rotation ring 14 is mounted to the housing together with the gun 2 will be described hereinafter.

Firstly, the shaft 36 of the connector 10 is rotationally connected with the rotation ring 14 by inserting the stepped portion 44 of the shaft 36 into the connecting hole 46 formed on the projection 12 of the rotation ring 14 and screwing nut 50 around the thread end portion of the stepped portion 44. The other ends of the shaft 36 is inserted into the receiving hole 34 of the connecting brackets 32 in order for the hole 40 of the shaft 36 to be arranged coaxially with the holes 38 of the connecting brackets 32, and the brockets 32 are engaged with the circumferential edge of the opening 6 such that fixing hole formed on the front wall 4 near a top and bottom ends of the opening 6 are arranged coaxially with respective holes 38 of the brackets 32 and the hole 40 of the shaft 36 and screwing up the bolts 42 into the holes 38. Accordingly, the rotation ring 14 is able to rotate in the opening 6 on the axes of the shafts 36.

Next, the gun 2 is rotationally connected to the rotation ring 14 in such a manner that the two connecting plates 22 are fixed to the gun 2 by interposing the gun 2 between the plates, screwing the bolts 28 into the fixing holes (not shown) formed both side of the lower portion of the barrel of the gun 2 through the fixing holes 30 formed at the lower portion of the connecting plates 22, and pivotally connecting the connecting plates 22 to corresponding studs 16 by penetrating the stepped portions 18 of the studs 16 into the holes 24 of the connecting plates 22 and screwing the nuts 26 on the threaded end 20 of the stepped portions 18. Accordingly, the gun 2 is mounted to the rotation ring 14 so as to rotate on the axes of the studs 16 perpendicular to the axes of the shafts 36.

Figure 9:
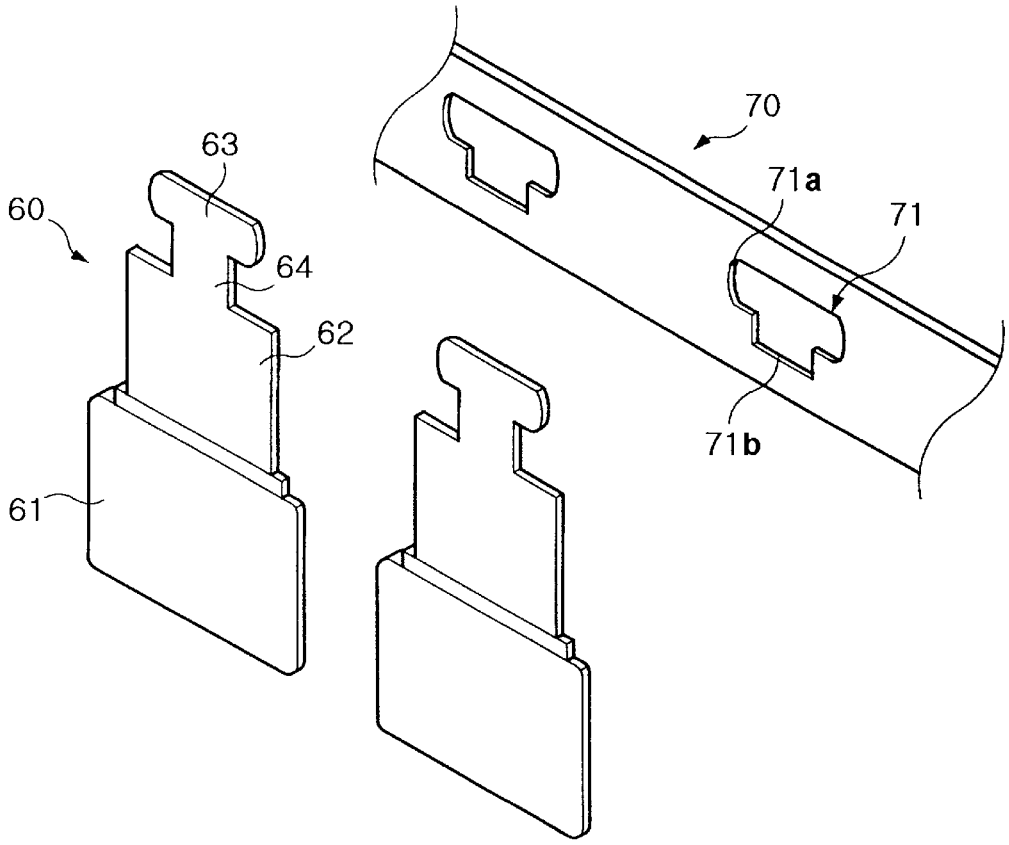
FIG. 9 is a perspective view showing a target holder and targets of the shooting game machine according to the preferred embodiment of the present invention.
Figure 10:
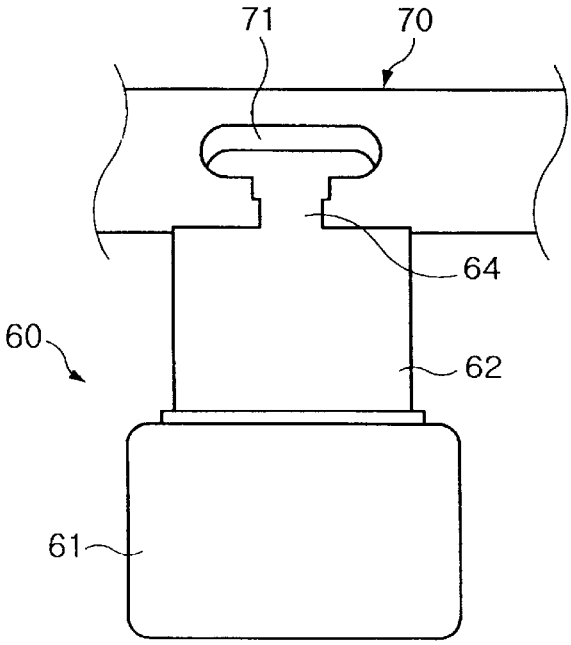
FIG. 10 is a perspective view for illustrating how the target is suspended from the target holder.

FIG. 9 partially shows a target holder and targets of the shooting game machine according to the preferred embodiment of the present invention.

As shown in FIG. 9, the target holder 70 is provided with a plurality of slots 71 having a shape of "T" and the target 60 has a body 62 and a suspender 63, having a shape of "T" corresponding to the slot 71, upwardly extended from the target 60 such that the target 60 is suspended from the target holder 70 in such a manner that the suspender 63 of the target 60 is inserted to the slot 71 through a wide opening portion 71*a*, moved down in order for a narrow neck 64 bridging the body 62 and the suspender 63 to be received into a holding part 71*b* of the slot 71, and pulled down.

Accordingly, the suspender 63 of the target 60 is held by the narrow holding part 71*b* of the slot 71 (see FIG. 9).

A gift 61 is suspended lower end of the target 60 and the target is preferably made out of a material which can be easily torn such that the gift 61 falls down when the target 60 is hit and torn by bullet.

Figure 11:
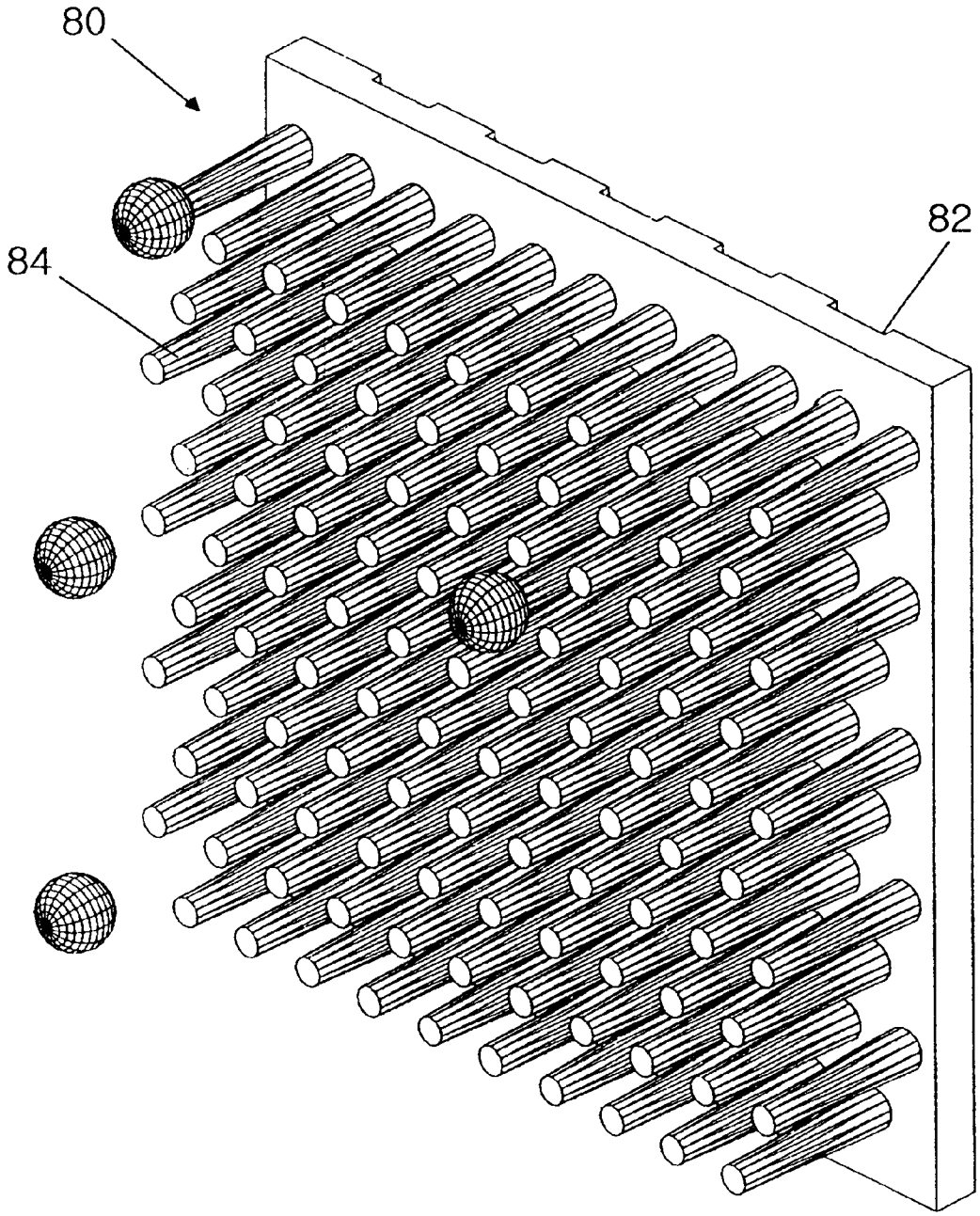
FIG. 11 is a partial perspective view showing a wall of a housing of the shooting game machine according to the preferred embodiment of the present invention.

FIG. 11 shows an impact absorbing member applied to inner walls of the housing 1 of the shooting game machine of the present invention.

As shown in FIG. 11, the impact absorbing member 80 comprises a plurality of elastic columns 84 projected from a inner surface of a plate 82 in a predetermined density. The impact absorbing member 80 is applied to a rear, upper, and side walls such that the impact of the bullets against the walls is absorbed by the elastic columns 84. This prevents the bullets from being broken.

The operation of the above structured shooting game machine of the present invention will be described hereinafter.

The rotation ring 14 is mounted in the opening 6 of the front wall 4 of the housing 1 using the connector 10 such that the rotation ring 14 can rotate left and right on the axes of the shafts 36 of the connector 10. Next, the gun 2 is installed in the rotation ring 14 by interposing the gun 2 between the studs 16 and connecting the gun 2 to the studs 16 using the connecting plates 22 and bolts 28 such that the gun 2 is able to pivot up and down on the axes of the studs 16 in the rotation ring 14. Consequently, the gun 2 can be controlled in all directions on the axes of the shafts 36 and the studs 16.

Also, since the front wall 4 of the housing 1 is transparent, the player can aim at the target 60 with the gun 12 while staring the target 60 through the transparent front wall 4.

Once a bullet is shot from the gun 2 in power of the compressed air after aim and misses the target, the bullet impact against the wall. In this case the impulsive force of the bullet against the wall is cushioned by the impact absorbing member 80 applied to the wall such that it is possible to speed down the bullet bouncing from the wall and prevent the bullet from being broken.

The target 60 is suspended from the target holder 70 by inserting the suspender 63 of the target 60 into the slot 71 of the target holder 70 and pulling down the target in order for the narrow neck 64 of the target 60 to be engaged with the holding part 71*b* of the slot 71 and for the suspender 63 to be held in the holding part 71*b* of the slot 71.

The target 60 is made out of a thin and scissile material such that if the target 60 is hit several times by bullets, the target is torn, resulting in falling the gift suspended from a lower end of the target 60. When replacing the target torn by bullets with new one, the target 60 is removed by putting up the target 60 in order for the suspender 63 to be located in the wide portion 71*a* of the slot 71 and pulling in frontward and then the new target is held in the same manner described above.

As described above, since the walls of the housing the shooting game machine is applied by the impacting absorbing member, the bullets missed the target can be prevented from being broken against the walls and the bouncing speed of the bulled can be slowed down.

Also, since the gun is fixed on the front wall of the housing 1, even when it is not used, by means of the supporter so as to rotate on the two axes, the player can more stably aiming at the target and it is prevented that the gun is stolen.

Furthermore, the target holder and the target are modified so as not to need to separate the target holder from the shooting game machine for changing the target such that the target replacement time is reduced.

What is claimed is:

1. A shooting game machine having a gun for projecting bullets using compressed air and targets arranged in a predetermined distance in front of the gun, comprising:

a housing which is provided with at least one opening formed on a front wall thereof;

a gun supporter mounted inside of the opening on the front wall of the housing for supporting the gun;

a target holding mechanism installed in front of the gun in a predetermined distance for holding at least one target; and an impact absorbing member comprised of a plurality of elastic columns projected from an inner surface of a plate, the plate disposed within the housing such that damage to the projected bullets is reduced by the impact absorbing member.

2. The shooting game machine of claim 1 wherein the front wall of the housing is made out of a transparent plate.

3. The shooting game machine of claim 1 wherein the gun supporter comprises:

a rotation ring having an outer diameter less than that of the opening;

a pair of connectors rotationally connecting the rotation ring with the front wall in the opening at upper and lower end portions of a circumferential edge of the opening; and a pair of studs connecting the gun to the rotation ring such that the gun rotates on an axis of the studs perpendicular to an axis on which the rotation ring rotates.

4. The shooting game machine of claim 3 wherein each connector comprises:

a connecting bracket having a shape of "U" such that an indented portion is engaged with circumferential edge of the opening of the front wall; and a cylindrical shaft of which one end is fixed to the connecting bracket and the other end having a stepped portion for rotationally connecting with the rotation ring.

5. The shooting game machine of claim 4 wherein the rotation ring has a pair of projections perpendicularly projected from the rotation ring at a longest distance therebetween on the rotation ring a having respective connection holes such that the stepped portions of the shafts are rotationally received in the respective connection holes.

6. The shooting game machine of claim 3 wherein the studs are oppositely and coaxially fixed on the rotation ring at an angle of 90° relative to the projections of the rotation rings.

7. The shooting game machine of claim 6 wherein each stud has a stepped end portion having a smaller diameter than that of the stud and threaded such that the gun is rotationally mounted between the studs in the rotation ring.

8. A shooting game machine having a gun for projecting bullets using compressed air and targets arranged in a predetermined distance in front of the gun, comprising:

a housing which is provided with at least one opening formed on a front wall thereof;

a gun supporter mounted inside of the opening on the front wall of the housing for supporting the gun; and a target holding mechanism installed in front of the gun in a predetermined distance for holding at least one target wherein the target holding mechanism comprises:

movable means for moving the targets;

driving means for driving the movable means; and at least one target holder horizontally mounted to the movable means, the target holder being provided with at least one slot having a shape of "T".

9. The shooting game machine of claim 8 further comprising:

at least one target for being inserted into the slot of the target holder and suspended therefrom wherein the target is provided with a body and a suspender connected to the body via a neck.

10. The shooting game machine of claim 9 wherein the slot of the target holder is provided with a wide portion having a same width as the suspender of the target in order for the suspender to be inserted into the slot through the wide portion and a holding portion for holding the suspender of the target.

11. The shooting game machine of claim 10 wherein the target is suspended from the target holder by inserting the suspender through the wide portion of the slot and pulling down the target such that the neck of the target is engaged with a holding portion and the suspender is held.

12. A shooting game machine having a gun for projecting bullets using compressed air and targets arranged in a predetermined distance in front of the gun, comprising:

a housing which is provided with at least one opening formed on a front wall thereof;

a gun supporter mounted inside of the opening on the front wall of the housing for supporting the gun;

a target holding mechanism installed in front of the gun in a predetermined distance for holding at least one target; and a plurality of elastic members applied on a surface of a plate of an inner wall of the housing for cushioning impact of the bullet against the inner wall.

13. The shooting game machine of claim 12 wherein the elastic members are rubber.

14. The shooting game machine of claim 13 wherein the elastic members have a shape of a tapered column projected from the plate.

15. The shooting game machine of claim 12 wherein the front wall of the housing is made out of a transparent plate.

16. The shooting game machine of claim 15 wherein the gun supporter comprises:

a rotation ring having an outer diameter less than that of the opening;

a pair of connectors rotationally the connecting rotation ring with the front wall in the opening at upper and lower end portions of a circumferential edge of the opening; and a pair of studs connecting the gun to the rotation ring such that the gun rotates on an axis of the studs perpendicular to an axis on which the rotation ring rotates.

17. The shooting game machine of claim 16 wherein each connector comprises:

a connecting bracket having a shape of "U" such that an indented portion is engaged with circumferential edge of the opening of the front wall; and a cylindrical shaft of which one end is fixed to the connecting bracket and the other end having a stepped portion for rotationally connecting with the rotation ring.

18. The shooting game machine of claim 17 wherein the rotation ring has a pair of projections perpendicularly projected from the rotation ring at a longest distance therebetween on the rotation ring an respective connection holes such that the stepped portions of the shafts are rotationally received in the respective connection holes.

19. The shooting game machine of claim 18 wherein the studs are oppositely and coaxially fixed on the rotation ring at an angle of 90° relative to the projections of the rotation rings.

20. The shooting game machine of claim 19 wherein each stud has a stepped end portion having a smaller diameter than that of the stud and threaded such that the gun is rotationally mounted between the studs in the rotation ring.

* * * * *

UNITED STATES PATENT AND TRADEMARK OFFICE

CERTIFICATE OF CORRECTION

PATENT NO. : 6,655,691 B2
DATED : December 2, 2003
INVENTOR(S) : Y. H. Kim

It is certified that error appears in the above-identified patent and that said Letters Patent is hereby corrected as shown below:

Title page,
Item [75], Inventor, "Kim Yong Hwan" should be -- Yong Hwan Kim --.

Column 6,
Line 2, "a" should be -- and --.

Column 7,
Line 3, "the connecting" should be -- connecting the --.

Column 8,
Line 4, "an" should be -- and having --.

Signed and Sealed this

Thirteenth Day of July, 2004

JON W. DUDAS
*Acting Director of the United States Patent and Trademark Office*